United States Patent [19]

Schwarz

[11] 4,305,432

[45] Dec. 15, 1981

[54] POSITIVE DOBBY

[75] Inventor: Rudolf Schwarz, Horgen-Zuerich, Switzerland

[73] Assignee: Staeubli Ltd., Horgen-Zuerich, Switzerland

[21] Appl. No.: 119,080

[22] Filed: Feb. 6, 1980

[30] Foreign Application Priority Data

Feb. 13, 1979 [CH] Switzerland ..... 1387/79

[51] Int. Cl.[3] ..... D03C 1/06

[52] U.S. Cl. ..... 139/66 A; 139/71

[58] Field of Search ..... 139/66 R, 66 A, 67, 139/71, 72, 73, 74

[56] References Cited

U.S. PATENT DOCUMENTS 3,169,554 2/1965 Schwarz ..... 139/66 A

FOREIGN PATENT DOCUMENTS 2131180 9/1972 Fed. Rep. of Germany .... 139/66 R
83121 5/1964 France ..... 139/66 A
319652 1/1972 U.S.S.R. ..... 139/66 A

*Primary Examiner*—Henry Jaudon
*Attorney, Agent, or Firm*—Blanchard, Flynn, Thiel, Boutell & Tanis

[57] ABSTRACT

A draw hook having a bearing end, the outside circumference of which projects beyond the end of the baulk and serves simultaneously as stop against the recoil or repulsion knife and the stop rail. The drawing force for the movement of the heddle frame occurs from the draw hook directly through the bolt onto the baulk. The reaction and the holding force act directly onto the bearing end of the draw hook.

9 Claims, 9 Drawing Figures

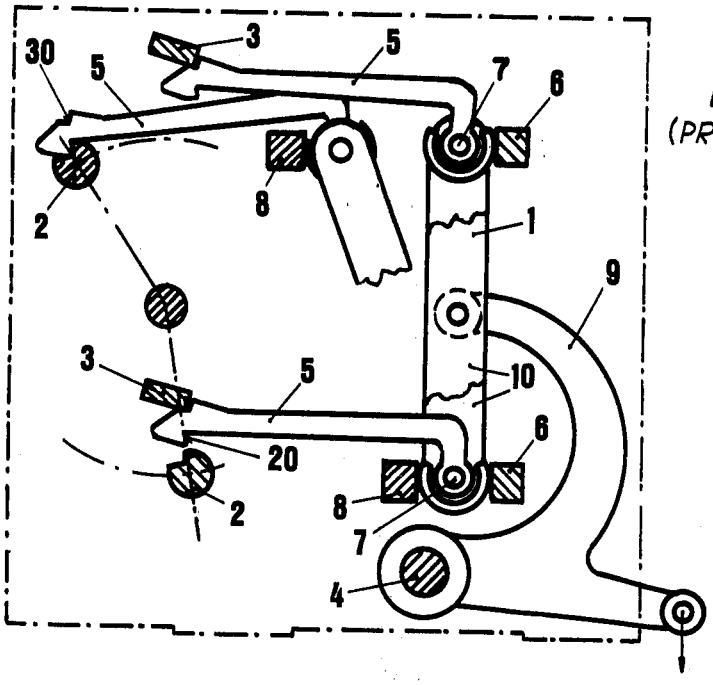
Fig.1
(PRIOR ART)
Fig.2
(PRIOR ART)
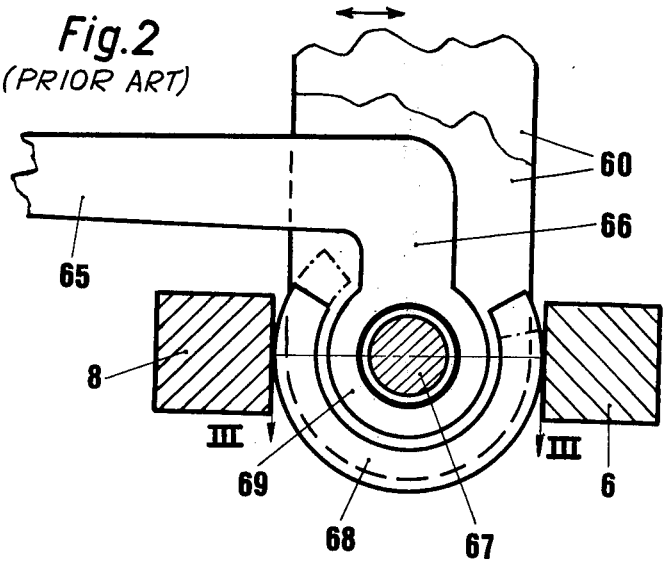
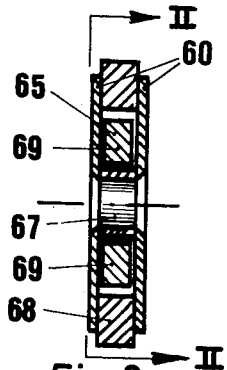
Fig.3
(PRIOR ART)

POSITIVE DOBBY

FIELD OF THE INVENTION

The invention relates to a positive dobby having a baulk, on the ends of which are arranged controlled draw hooks which are hinged thereto through bearing bolts, wherein the machine has stop rails and draw and/or push knives, which release and limit the movement of the baulk.

BACKGROUND OF THE INVENTION

The weaving machines which are controlled by means of dobbies are constantly being further developed with respect to higher operating needs. The mass accelerations of the heddle frame result in higher forces acting onto the control members and an increased demand for a playfree operation.

These strong stresses which occur in the positive dobbies of the Hattersley construction lead to a quick wear at the ends of the baulk. It has been heretofore suggested to provide the ends of the baulks with reinforcing elements, for example in the form of ring segments, which serve to absorb the occurring support forces. These ring segments on the baulk ends are caught and held during the control period between the stop rails and the repulsion knives. Movements are thereby detected at the ends of the baulk, which movements result in a quick wear in the case of heavily stressed machine parts. The cause for this lies, on the one hand, in the complex construction of the draw hook baulk end not being able to be manufactured sufficiently exactly in the common form and at a reasonable expense and this, therefore, results in a nonpermissible play relative to the stop rail and the repulsion knife and the draw and support knife. As a result, impacts which occur due to the relative movement between the parts lead to an excessive overload of the machine parts. On the other hand, the ring segments cause at the ends of the baulk, due to the line contact point to the stop rail and to the repulsion knife, a specific load to be applied, through which common building materials are overloaded. Simultaneously with the creation of these high specific surface pressures, the lubricating film is pierced at the contact points. Soon dents occur due to a plastic deformation of the material and a material removal at the contact points occurs due to the lack of lubrication at these points. Due to the complex forms and relative movements, the wear continues in an accentuated manner. This wear leads first to unsteady frame movements and requires then the replacement of the worn parts, which results in undesirable interruptions in the operation.

The purpose of the invention is to reduce the friction path and the specific load and initial play which exists due to inexactnesses.

This is inventively achieved in the above-mentioned dobby by the external part of the bearing ends of the controllable draw hooks resting directly against the stop rails or repulsion knives, which causes the bearing ends to be caught during the control period of the draw hooks between the stop rail and the repulsion knife. The bearing end of the draw hook thus contacts the stop rail and the repulsion knife instead of the ends of the baulk. In the normal position, the bearing end of the draw hook is caught playfree between these two parts, which causes the draw hook to be held stationarily.

The inventive arrangement attains the purpose of facilitating a construction of the sensitive part in the dobby in such a manner that a more exact manufacture with a smaller initial play becomes easily attainable and that the support point between the end of the baulk and the stop rail or the repulsion knife results in a smaller specific stress and a simultaneously reduced friction path. At the same time, it became possible to shorten the swanneck between the bearing end of the draw hook and the elongated draw hook shaft, which swanneck was acted upon by the relatively voluminous ring segment, and to obtain a stronger form of the draw hook, which under a load tends to bend correspondingly less, namely elastically deforming along the length and thus forwards less interferingly movements to the weaving heddle frame.

This new arrangement results in the space between the stop rail and the repulsion knife (control period), the body of the draw knife and the repulsion knife and the support or holding knife and the stop rail being now occupied only by one and the same controllable individual element, namely the draw hook, wherein in place of the ring segment the outer surface of the bearing end of the draw hook rests directly selectively on the stop rail, the repulsion knife or during the control period on both simultaneously. The position of the bore in the bearing end may have a relatively large inexactness, without influencing the function of the machine. The outer form of the bearing end at the mentioned contact points may have a cylindrical or different convex form. In addition the outer form of the bearing end, in particular in the cylindrical version thereof, may be enclosed by a mounting shoe, for example of plastic, and rotatably limited with respect to the bearing end, which shoe is provided on the outside preferably with a surface, which forms an operative connection with the countersurface on the stop rail or the repulsion knife.

BRIEF DESCRIPTION OF THE DRAWINGS

Various exemplary embodiments are illustrated in the drawings, in connection with which the invention will be explained.

In the drawings:

FIG. 1 is a schematic side view of the design of a positive dobby, wherein the draw hooks are supported in a conventional manner freely rotatably on bolts at the end of the baulk and said end of the baulk rests against the repulsion knife or against the stop rail;

FIG. 2 is an enlarged view of the end of the baulk which has been cut open along the line II—II of FIG. 3;

FIG. 3 is a cross-sectional view of the end of the baulk according to FIG. 1 and taken along the line III—III of FIG. 2;

DETAILED DESCRIPTION

Figure 4:
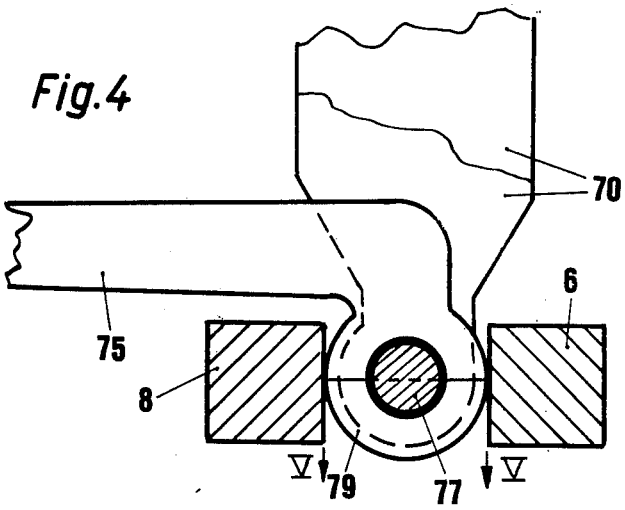
FIG. 4 is a view of the end of the baulk according to the invention, which end has been cut open.

A positive dobby according to FIG. 1 is part of the prior art and has principally a baulk 1, which consists of two plates 10 which extend parallel to one another and which are connected at each of their ends by a bolt 7. One draw hook 5 is freely rotatably supported on each bolt at the end of the baulk. Reference numeral 2 identifies the draw knives and reference numeral 8 identifies the repulsion knives for releasing the movement of the draw hooks. In the rear rest position, the ends of the baulk rest on a stop rail 6, wherein the ends of the draw hooks remote from the baulk engage in a lifted position thereof behind a holding knife 3. The movement of the baulk 1 is transmitted through a rocking lever 9, which is pivotally supported on an axle 4, to the heddle frame by structure which is not shown.

In this known construction of the end of the baulk and the support of the draw hook 65 according to FIGS. 2 and 3, same sits freely rotatably on the bolt 67 connecting the two plates 60 of the baulk together. A segment of a ring 68 of a relatively large diameter is secured concentrically with respect to the bolt 67 and between the plates 60, which ring segment extends laterally beyond the edges of the plates and also outwardly beyond the bearing end 69 of the draw hook and on the one side rests against the stop rail 6 and on the other side against the repulsion knife 8. During a swinging back and forth movement of the illustrated draw hook or of the baulk end, the ring segment 68 reaches relative to the draw hook 65,69 the position illustrated in dash-dotted lines in FIG. 2. Therefore, the draw hook 65 must extend up from the bearing end 69 over a long swanneck 66 and can only then be bent. This results in a weakening and a loss of stability of the draw hook due to an elastic deformation thereof. The ring segment 68 lies during the movement of the draw hook always on a line against the repulsion knife 8, the stop rail 6 or during the control operation against both parts. A reciprocal up and down movement can occur, and also a relatively large swivel movement, which results in a friction and thus causes wear. This is a disadvantage. In contrast to this there exists the advantage that the draw hook 65 remains at any time freely swingable, which makes its movement easier in particular during reading-in through a free gravity fall.

Figure 5:
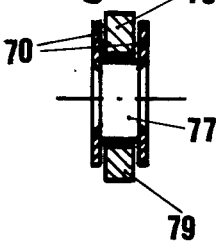
FIG. 5 is a cross-sectional view of said baulk end and taken along the line V—V of FIG. 4.

FIGS. 4 and 5 illustrate an inventive modification. The baulk again consists of two plates 70, the ends of which are connected together through the bolt 77. The bearing end 79 of the draw hook 75 is supported freely rotatably on the bolt, wherein the outside circumference of the bearing end extends radially beyond the baulk plates and the bearing end rests against the repulsion knife 8 and the stop rail 6. Due to this direct abutment, the position of the axis of the bore in the bearing end 79 and the axis of the bolt 77 in the baulk end may have a relatively large inexactness, without interfering with the function of the draw hooks 75. The swinging baulk 70 is classically supported by the bolt 77 in the bearing end 79 and is only yet indirectly connected to the stop rail 6 and the repulsion knife 8. Since only an extremely small relative movement remains between the bearing end and the stop rail and the repulsion knife, hardly any wear will occur any longer at the contact points. The contact pressure between bearing end 79 and repulsion knife 8 or stop rail 6 is the same as in the case of the ring segment 68 in FIGS. 2 and 3.

Figure 6:
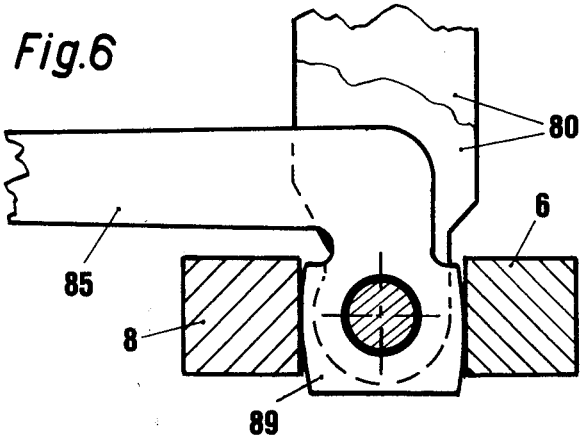
FIG. 6 is a view of the baulk end, which has been cut open, according to a modification of the invention.

In the modified embodiment according to FIG. 6, the bearing end 89 has an approximately cubic shape. Compared with the surfaces on the repulsion knife 8 or the stop rail 6, the contact surfaces are constructed slightly convexly, which results in a surface contact rather than a line contact therebetween. A higher loading capability of the contact point is obtained and the wear on the outer surfaces of the bearing end is less.

Figure 9:
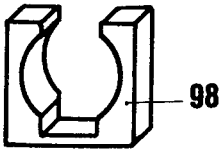
FIG. 9 is a perspective view of the mounting shoe of this embodiment.
Figure 7:
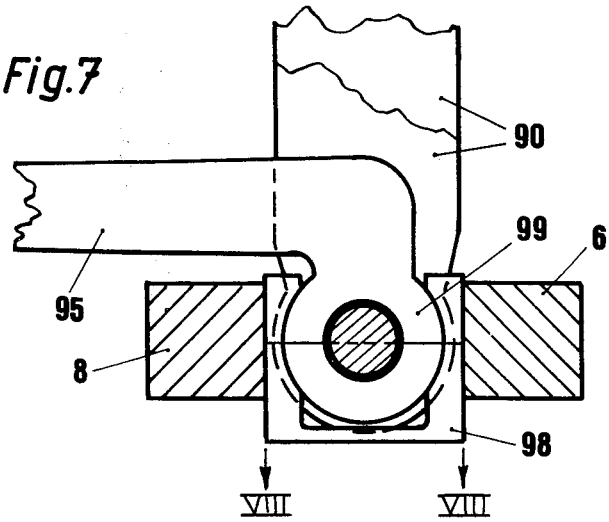
FIG. 7 is a view of the baulk end, which has been cut open, according to a further modification of the invention.
Figure 8:
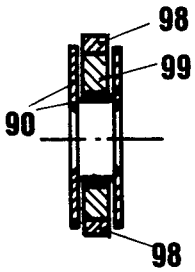
FIG. 8 is a cross-sectional view of said baulk end and taken along the line VIII—VIII of FIG. 7.

In order to reduce the support pressure per surface unit between the bearing end 99 and the repulsion knife 8 or stop rail 6, the bearing end 99 of the draw hook 95 is, according to the modification in FIGS. 7 to 9, embedded rotatably in a mounting shoe 98. The side surfaces of this shoe rest at any time fully on the knife 8 or the rail 6, however, they move in parallel direction during the up and down movement of the baulk which is formed by the plates 90. This shoe facilitates a large-surface contact between the bearing end and the repulsion knife 8 or the stop rail 9. The shoe can for example due to its extremely large contact surfaces consist of plastic. Its position in the space is always assured through the close contact either with the repulsion knife and/or the stop rail.

In the case of all three last described inventive modifications, a long swanneck is not needed between the draw hook 75,85 or 95 and the bearing end 79,89 or 99, namely the draw hook has therefore an elongated shape. In spite of this playfree mounting of the bearing end between repulsion knife and stop rail, the draw hook must, however, be swingable through a few degrees to accommodate the reading-in and reading-out movement, which is achieved due to the rounding of the bearing end.

As mentioned above, the advantage of the described dobby is that the bearing end of the draw hook carries out only yet a small swivel movement (hook control) relative to the stop rail and the push knife, while the working baulk rotates only in the bearing bore of both draw hooks. In the first case, the bearing end absorbs the small friction operation without any damage worth mentioning and in the second case the baulk operates with a classically constructed shaft bearing. Furthermore, the considerable support forces of the bearing end on the stop rail and on the repulsion knife with reasonable specific pressures can be absorbed by the parts, if the mentioned mounting shoe is utilized. The requirement to fill in the spacing between the stop rail 6 and the repulsion knife 8, the body of the draw knife 2 and the repulsion knife and the holding knife 3 and the stop rail 6 through the controllable member so that the end of the baulk 10 is always locked or driven playfree, is met according to the invention by having only one single element, the draw hook 5, serve as a power transmitter which is to be precisely manufactured. The distances between the outer form of the bearing end 79,89,98/99, the connecting surface 20 for the draw knife 2 and the support surface 30 for the holding knife 3 and the diameter of the bearing end are decisive for precision purposes in determining the sizes of the draw hooks 5,75,85,95. Only three dimensions must be precisely maintained for the play freedom on said draw hook, while the old solution included five dimensions, in addition to two inexact conditions during the assembly. Due to the omission of the relatively voluminous ring segment in the swinging baulk end, it is possible to remarkably shorten and at the same time widen the long swanneck which has heretofore been dimensioned only narrow, between the bearing end of the draw hook and the elongated draw hook shaft. Through this, the draw hook receivesan elongated form which under a load reacts with a lesser longitudinal expansion as a result of the elastic bending action and thus is able to transmit more exactly the movement of the draw knife onto the heddle frame.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a positive dobby having a baulk on the ends of which are arranged controlled draw hooks which are hinged thereto through bearing bolts extending through a bearing end on said draw hook, wherein said dobby has a stop rail and a repulsion knife, which release and limit the movements of the baulk, the improvement comprising wherein said bearing end of said controlled draw hook rests directly against said stop rail and said repulsion knife, which causes said bearing end to be directly engaged, during the control period of said draw hook, with and between said stop rail and said repulsion knife.

2. The dobby according to claim 1, wherein said bearing end of said draw hook is angled relative to the longitudinal extent of the same ony so far that said draw hook will lie directly above and said bearing end directly behind said repulsion knife.

3. The dobby according to claim 1, wherein said bearing end of said draw hook is enlarged to form a ring and is positioned with its inner bore on said bearing bolt, wherein the outside circumference of said bearing end is curved convexly and extends beyond the outer circumference of the corresponding baulk ends.

4. The dobby according to claim 3, wherein said outer circumference of said bearing end of said draw hook is constructed circularly at least in the area of the contact thereof with said stop rail and said repulsion knife.

5. The dobby according to claim 3, wherein said outer circumference of said bearing end of said draw hook has two oppositely positioned, approximately parallel arranged surfaces, which are constructed slightly convexly.

6. The dobby according to claim 1, wherein said bearing end of said draw hook is constructed as a ring and is rotatably supported in a mounting shoe, which shoe projects with its outer circumference beyond the associated end of said baulk and has two oppositely positioned, approximately parallel lying surfaces.

7. The dobby according to claim 1, wherein draw knives are provided for pulling out said controlled draw hook and holding knives are provided for holding back a non-controlled draw hook in a base position, wherein depending on the operating position of said dobby, the space between said stop rail and said repulsion knife is occupied by one and the same bearing end.

8. The dobby according to claim 1, wherein draw knives are provided for pulling out said controlled draw hook and holding knives are provided for holding back a non-controlled draw hook in a base position, wherein depending on the operating position of said dobby, the space between said stop rail and said repulsion knife is occupied by said draw hook, namely, the portion thereof extending between a connecting surface on said repulsion knife and said stop rail.

9. The dobby according to claim 1, wherein draw knives are provided for pulling out said controlled draw hook and holding knives are provided for holding back a non-controlled draw hook in a base position, wherein depending on the operating position of said dobby, the space between said stop rail and said repulsion knife is occupied by said draw hook, namely, the portion thereof extending between a connecting surface on said holding knife and said stop rail.

* * * * *

UNITED STATES PATENT AND TRADEMARK OFFICE

CERTIFICATE OF CORRECTION

PATENT NO. : 4 305 432

DATED : December 15, 1981

INVENTOR(S) : Rudolf Schwarz

It is certified that error appears in the above—identified patent and that said Letters Patent is hereby corrected as shown below:

Column 5, line 30; change "ony" to ---only---.

Signed and Sealed this

*Sixteenth* Day of *March 1982*

[SEAL]

*Attest:*

GERALD J. MOSSINGHOFF

*Attesting Officer*

*Commissioner of Patents and Trademarks*